US008829882B2

(12) United States Patent
Willey

(10) Patent No.: US 8,829,882 B2
(45) Date of Patent: Sep. 9, 2014

(54) CURRENT GENERATOR CIRCUIT AND METHOD FOR REDUCED POWER CONSUMPTION AND FAST RESPONSE

(75) Inventor: Aaron Willey, Burlington, VT (US)

(73) Assignee: Micron Technology, Inc., Boise, ID (US)

( * ) Notice: Subject to any disclaimer, the term of this patent is extended or adjusted under 35 U.S.C. 154(b) by 786 days.

(21) Appl. No.: 12/872,854

(22) Filed: Aug. 31, 2010

(65) Prior Publication Data

US 2012/0049817 A1 Mar. 1, 2012

(51) Int. Cl.
*G05F 3/16* (2006.01)
*G05F 3/20* (2006.01)

(52) U.S. Cl.
CPC ..... *G05F 3/20* (2013.01)
USPC ..... 323/315; 323/313

(58) Field of Classification Search
USPC ..... 323/282, 285, 288, 311–315, 317
See application file for complete search history.

(56) References Cited

U.S. PATENT DOCUMENTS 4,714,900 A * 12/1987 Sata ..... 331/8
5,798,669 A * 8/1998 Klughart ..... 327/539
5,847,556 A * 12/1998 Kothandaraman et al. ... 323/315
5,864,228 A * 1/1999 Brown et al. ..... 323/315
6,407,619 B1 * 6/2002 Tanaka ..... 327/536
7,250,883 B2 * 7/2007 Suzuki ..... 341/135
7,423,476 B2 9/2008 Tang ..... 327/543
7,705,664 B2 4/2010 Tang ..... 327/543
7,944,300 B2 * 5/2011 Jurasek et al. ..... 330/261
2006/0113982 A1 * 6/2006 Plojhar ..... 323/315
2010/0141335 A1 * 6/2010 Bedeschi et al. ..... 327/543
2011/0204981 A1 * 8/2011 Jurasek et al. ..... 330/296
2012/0001663 A1 * 1/2012 Willey ..... 327/109

* cited by examiner

*Primary Examiner* — Jeffrey Sterrett
(74) *Attorney, Agent, or Firm* — Dorsey & Whitney LLP

(57) ABSTRACT

Current circuits, circuits configured to provide a bias voltage, and methods for providing a bias voltage are described, including a current circuit configured to receive a reference current and having an output at which an output current is provided. One such current circuit includes a first current mirror configured to receive a first portion of the reference current and further configured to mirror the first portion of the reference current to provide a first current. The current circuit further includes a second current mirror configured to receive a second portion of the reference current and receive the first current. The second current mirror is further configured to provide a portion of the first current to the output of the current circuit as the output current and to receive another portion of the first current and mirror the same as the second portion of the reference current.

24 Claims, 2 Drawing Sheets

CURRENT GENERATOR CIRCUIT AND METHOD FOR REDUCED POWER CONSUMPTION AND FAST RESPONSE

TECHNICAL FIELD

Embodiments of the invention relate generally to circuits, and more specifically, in one or more illustrated embodiments, to circuits for generating an output current.

BACKGROUND OF THE INVENTION

FIG. 1 illustrates a conventional current circuit 100 having a diode coupled n-channel transistor 120 coupled to a capacitor 150 to provide a bias voltage BIAS. A current source 110 is coupled to provide a reference current IREF to the current circuit 100. In operation, the current circuit 100 provides the IOUT current to maintain a stable BIAS voltage on the capacitor 150. For example, where the BIAS voltage is balanced, that is, the BIAS voltage is neither increasing or decreasing due to the IOUT current, the transistor 120 is biased to conduct a current IO1 that is equal to the IREF current. The IOUT current is 0 for this condition. In the case where BIAS voltage on the capacitor 150 is less than the balanced BIAS voltage, the transistor 120 is made less conductive, and as a result, the IO1 current decreases. The decrease in the IO1 current causes the IOUT current to increase and charge the capacitor 150 to increase the BIAS voltage. As the increasing BIAS voltage returns to the balanced BIAS voltage, the IO1 current increases to be equal to the IREF current, thus the IOUT current no longer charges the capacitor 150. In the case where the BIAS voltage is greater than the balanced BIAS voltage, the transistor 120 is made more conductive and the IO1 current increases. The increase in the IO1 current causes the IOUT current to be drawn from the capacitor thereby discharging it to reduce the BIAS voltage. As the decreasing BIAS voltage returns to the balanced BIAS voltage, the IO1 current decreases to be equal to the IREF current, thus the IOUT current no longer discharges the capacitor 150.

As illustrated in the previous discussion, the current circuit 100 adjusts to provide a stable BIAS voltage. It may be desirable, however, to have alternative current circuits. For example, where reducing power consumption is desirable, providing a current circuit that can be used to provide a BIAS voltage using less current than the conventional current circuit, such as current circuit 100, may be desirable. Another example is where a faster response, that is, the ability for a current circuit 100 to stabilize a BIAS voltage, is desirable, a current circuit providing increased response may be desirable.

DETAILED DESCRIPTION

Certain details are set forth below to provide a sufficient understanding of embodiments of the invention. However, it will be clear to one skilled in the art that embodiments of the invention may be practiced without these particular details. Moreover, the particular embodiments of the present invention described herein are provided by way of example and should not be used to limit the scope of the invention to these particular embodiments. In other instances, well-known circuits, control signals, timing protocols, and software operations have not been shown in detail in order to avoid unnecessarily obscuring the invention.

Figure 2:
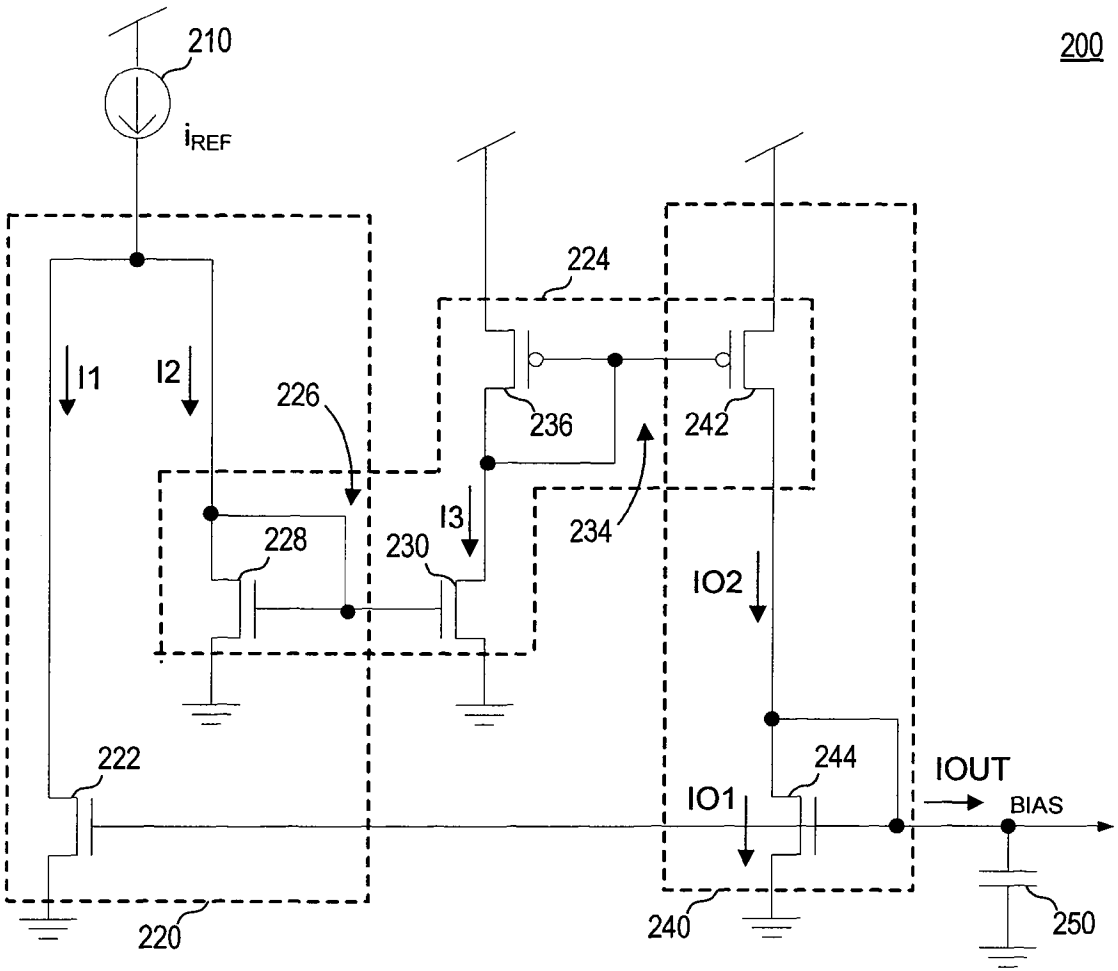
FIG. 2 is a schematic drawing of a current mirror circuit according to an embodiment of the invention.

FIG. 2 illustrates a current generator circuit 200 according to an embodiment of the invention. The current circuit 200 is shown in FIG. 2 as outputting an output current IOUT based on a reference current IREF from a current source 210 to a capacitance (e.g. a capacitor) 250 to provide a bias voltage BIAS. The current circuit 200 includes a current subtraction stage 220 and a current output stage 240. The IREF current is provided to transistors 222 and 228. The IREF current is split into currents I1 and I2. The I2 current is provided to a current mirror stage 224 that overlaps portions of the current subtraction and current output stages 22, 240. The current mirror stage 224 mirrors the I2 current to provide an IO2 current.

In the embodiment shown in FIG. 2, the current mirror stage 224 includes current mirrors 226 and 234. Transistor 230 is coupled to transistor 228 to form current mirror 226. Transistor 236, which along with transistor 242 form current mirror 234, is coupled to transistor 230 to receive a mirrored current I3 of current mirror 226 as an input current to the current mirror 234. The transistor 242 is coupled to diode-coupled transistor 244, which has a gate coupled to a gate of the transistor 222 to form a current mirror. In the embodiment of FIG. 2, transistors 222, 228, 230 and 244 are shown as n-channel transistors (e.g., n-channel field effect transistors (NFET)) and transistors 236 and 242 are shown as p-channel transistors (e.g., p-channel field effect transistors (PFET)). In other embodiments, different types and/or different combinations of transistors may be used. In still other embodiments, n-type and p-type transistors may be switched from that shown in FIG. 2. For example, in other embodiments of the invention transistors 222, 228, 230, and 244 are switched to p-channel transistors and transistors 236 and 242 are switched to n-channel transistors.

In operation, the current subtraction stage 220 is used with the current output stage 240 to adjust the IOUT current, which is based on the IREF current, to provide a balanced BIAS voltage on the capacitor 250. A balanced BIAS voltage is present at the capacitor 250 when currents I1 and I2 of the current subtraction stage 220 are equal. The following examples illustrate operation of the current circuit 200.

The I2 current is mirrored by current mirror 226 to provide the I3 current equal to the I2 current. Likewise, current mirror 234 mirrors the I3 current to the IO2 current. In a first example where a balanced BIAS voltage is present at the capacitor 250, the IO2 current is sunk through transistor 244 as current IO1. That is, IO1=IO2, and consequently, the IOUT current is 0, neither charging nor discharging the capacitor 250. The IO1 current is mirrored through transistor 222 of current mirror 246 so that the I1 current is equal to the IO1 current. Thus, where a balanced BIAS voltage is present at the capacitor 250, I1=I2=I3=IO2=IO1.

When the BIAS voltage at the capacitor 250 is less than the magnitude of the balanced BIAS voltage, the transistor 244 is made less conductive, and as a result, the IO1 current is less than the IO2 current. The difference IO2-IO1 is output as the IOUT current to charge the capacitor 250. The decreased IO1 current is mirrored by transistor 222 to decrease the I1 current. As previously discussed, IREF=I1+I2, or in other terms, I2=IREF−I1. With a constant IREF current, the decrease in the I1 current results in a relative increase in the I2 current. The increased I2 current is mirrored by current mirror 226 to provide an increased I3 current. In turn, current mirror 234 mirrors the increased I3 current as an increased IO2 current.

As a result, in addition to the difference IO2–IO1 being output as the IOUT current to charge the capacitor 250, as previously discussed, the IO2 current is also increased to further increase the IOUT current to charge the capacitor 250. The increased IOUT current will diminish as the BIAS voltage approaches the magnitude of the balanced BIAS voltage, and the current circuit 200 returns to the balanced condition of IOUT=0 when the balanced BIAS voltage is reached.

When the BIAS voltage at the capacitor 250 increases to greater than the balanced BIAS voltage, the transistor 244 is made more conductive and the IO1 current increases. The increase in the IO1 current results in discharging the capacitor 250, that is, the IOUT current has a negative polarity to contribute to the IO1 current. The increased IO1 current is mirrored by the transistor 222 to increase the I1 current. The increased I1 current has the effect of decreasing the I2 current into the current mirror 226 (i.e., IO2=IREF–I1, a greater I1 current results in a lesser I2 current). The decreased I2 current is mirrored as a decreased I3 current, which is in turn mirrored through current mirror 234 to decrease the IO2 current. As a result, in addition to discharging the capacitor due to the increased IO1 current, the IO2 current is also reduced to further increase the discharge current (i.e., negative IOUT current) from the capacitor 250. The discharge current will diminish as the BIAS voltage decreases to the magnitude of the balanced BIAS voltage, and the current circuit 200 returns to the balanced condition of IOUT=0 when the balanced BIAS voltage is reached.

Figure 1:
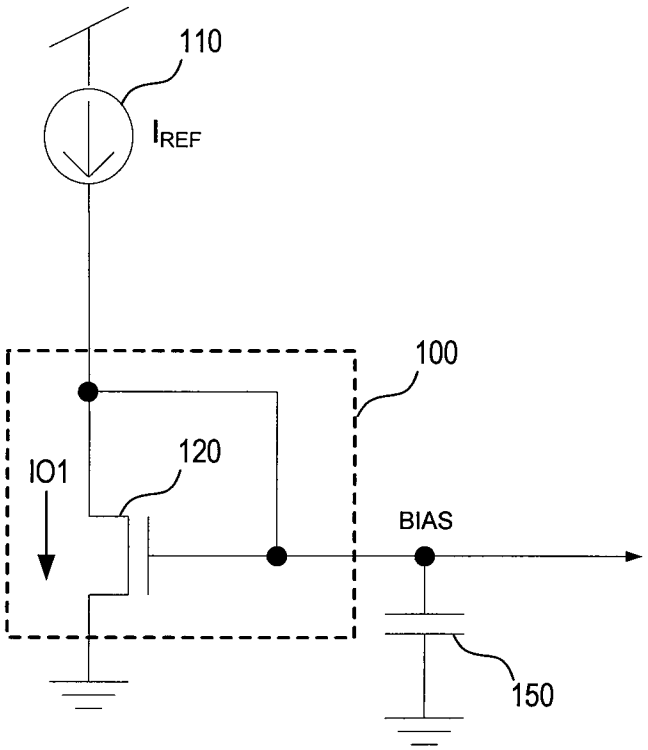
Fig. 1 (prior art)
FIG. 1 is a schematic drawing of a conventional current mirror circuit.

As illustrated by the previous examples, response time of the current circuit 200 to changes in the BIAS voltage may be improved over conventional current circuits, such as current circuit 100 of FIG. 1, due to the increasing and decreasing of the IO2 current, which is a contributor to the charging or discharging current (i.e., IOUT) applied to the capacitor 250.

In some embodiments, the transistors of the current circuit 200 are scaled to scale the IO1 and IO2 currents relative to the IREF current. For example, assuming transistors 222, 228, and 230 have transistor dimensions characterized by "X" and transistor 236 has transistor dimensions characterized by "Y," the IO1 and IO2 currents can be scaled by scaling the dimension of transistors 242 and 244, for example, A*Y for transistor 242 and A*X for transistor 244, where A is a scale factor. Thus, assuming A=10, the magnitude of the IO2 current will be approximately 10 times the magnitude of the I2 current and the magnitude of the IO1 current will be approximately 10 times the magnitude of the I1 current. Although the scaling factor was previously described as being the same for transistors 242 and 244, this need not be the case and the transistors of the current circuit 200 can be scaled according to different scaling factors.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A current circuit configured to receive a reference current and having an output at which an output current is provided, the current circuit comprising:

a first current mirror configured to receive a first portion of the reference current and further configured to mirror the first portion of the reference current to provide a first current; and a second current mirror configured to receive a second portion of the reference current and coupled to the first current mirror to receive the first current, the second current mirror configured to provide a portion of the first current to the output of the current output current and further configured to receive another portion of the first current and mirror the same as the second portion of the reference current.

2. The current circuit of claim 1 wherein the sum of the first and second portions of the reference current is equal to the reference current.

3. The current circuit of claim 1 wherein the sum of the output current and the another portion of the first current is equal to the first current.

4. The current circuit of claim 1 wherein the second current mirror comprises:

a diode coupled first n-channel transistor configured to receive the first current; and a second n-channel transistor having a gate coupled to a gate of the first n-channel transistor and configured to receive the second portion of the reference current.

5. The current circuit of claim 4 wherein the diode coupled first n-channel transistor has transistor dimensions different than transistor dimensions of the second n-channel transistor.

6. The current circuit of claim 4 wherein the first current mirror comprises:

an n-channel current mirror configured to receive the first portion of the reference current and mirror the same to provide an intermediate current; and a p-channel current mirror configured to receive the intermediate current and mirror the same to provide the first current.

7. The current circuit of claim 6 wherein the p-channel current mirror comprises a diode coupled first p-channel transistor having a gate coupled to a gate of a second p-channel transistor, the second p-channel transistor having transistor dimensions different than transistor dimensions of the diode coupled first p-channel transistor.

8. The current circuit of claim 6 wherein the n-channel current mirror comprises first and second n-channel transistors, the first n-channel transistor diode coupled and having a gate coupled to a gate of the second n-channel transistor.

9. The current circuit of claim 8 wherein the n-channel transistors of the n-channel current mirror have different transistor dimensions.

10. The current circuit of claim 1, further comprising a capacitor coupled to the output of the current circuit.

11. A circuit configured to provide a bias voltage, the circuit comprising:

a capacitance having a node at which the bias voltage is provided;

a current source configured to provide a reference current;

a current subtraction stage coupled to the current source and configured to split the reference current into first and second currents, the first current adjusted responsive to the bias voltage and the second current based at least in part on the first current;

a current mirror stage coupled to the current subtraction stage to receive the second current and mirror the second current to provide a mirrored current;

a current output stage coupled to the current mirror stage to receive the mirrored current and having an output coupled to the capacitance, the current output stage configured to provide an output current to the capacitance based at least in part on the mirrored current and the bias voltage.

12. The circuit of claim 11 wherein the second current is based at least in part on a difference between the reference current and the first current.

13. The circuit of claim 11 wherein the current mirror stage comprises:

a first current mirror configured to mirror the second current to provide an intermediate current; and a second current mirror coupled to the first current mirror and configured to mirror the intermediate current to provide the mirrored current.

14. The circuit of claim 13 wherein the first current mirror comprises:

a pair of n-channel transistors having gates coupled together, one of the n-channel transistors diode connected and configured to receive the second current; and wherein the second current mirror comprises:

a pair of p-channel transistors having gates coupled together, one of the p-channel transistors diode connected and configured to receive the intermediate current.

15. The circuit of claim 11 wherein the current subtraction stage comprises:

a transistor coupled to the current source and having a gate coupled to the output of the current output stage.

16. The circuit of claim 11 wherein the current output stage comprises:

a diode coupled transistor configured to receive the mirrored current and having a gate coupled to the output of the current output stage.

17. The circuit of claim 11 wherein the current subtraction stage comprises a transistor coupled to the current source and having a gate coupled to the output of the current output stage and the current output stage comprises a diode coupled transistor configured to receive the mirrored current and having a gate coupled to the output of the current output stage, the diode coupled transistor of the current output stage having transistor dimensions greater than transistor dimensions of the transistor of the current subtraction stage.

18. A method for providing a bias voltage, comprising:

providing an output current having first and second current components, the sum of which equal to the output current, the first current component for charging or discharging a capacitance; and adjusting the output current based at least in part on the second current component of the output current.

19. The method of claim 18 wherein adjusting the output current comprises:

increasing the output current responsive to a decrease in the second current component; and decreasing the output current responsive to an increase in the second current component.

20. The method of claim 18 wherein providing the output current having first and second current components comprises:

dividing a reference current into first and second reference current components;

mirroring the first reference current component to provide the output current; and adjusting the second reference current component responsive to the second current component of the output current.

21. The method of claim 20 wherein adjusting the second reference current component response to the second current component of the output current comprises mirroring the second current component of the output current to the second reference current component of the reference current.

22. The method of claim 20 wherein adjusting the output current comprises:

adjusting a ratio of the first and second reference current components responsive to the second current component of the output current.

23. The method of claim 20 wherein mirroring the first reference current component to provide the output current comprises:

mirroring the first reference current component to provide an intermediate current; and mirroring the intermediate current to provide the output current.

24. The method of claim 18 wherein providing an output current having first and second current components comprises providing the output current to a diode coupled transistor, the capacitor coupled to a gate of the transistor.

* * * * *

UNITED STATES PATENT AND TRADEMARK OFFICE

CERTIFICATE OF CORRECTION

PATENT NO. : 8,829,882 B2
APPLICATION NO. : 12/872854
DATED : September 9, 2014
INVENTOR(S) : Willey It is certified that error appears in the above-identified patent and that said Letters Patent is hereby corrected as shown below:

In the Claim

Column 4, line 2, Claim 1, delete "current" and insert -- current circuit as the --, therefor.

Signed and Sealed this
Eighteenth Day of November, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,829,882 B2
APPLICATION NO. : 12/872854
DATED : September 9, 2014
INVENTOR(S) : Willey It is certified that error appears in the above-identified patent and that said Letters Patent is hereby corrected as shown below:

In the Claim

Column 4, line 2, Claim 1, delete "current" (Second Occurrence) and insert -- current circuit as the --, therefor.

This certificate supersedes the Certificate of Correction issued November 18, 2014.

Signed and Sealed this
Sixteenth Day of December, 2014

Michelle K. Lee

Michelle K. Lee
*Deputy Director of the United States Patent and Trademark Office*